US009151065B1

(12) United States Patent
Francies, III

(10) Patent No.: US 9,151,065 B1
(45) Date of Patent: Oct. 6, 2015

(54) PRECAST CONCRETE LIFT ANCHOR ASSEMBLY

(71) Applicant: Sidney E. Francies, III, Lithia, FL (US)

(72) Inventor: Sidney E. Francies, III, Lithia, FL (US)

(73) Assignee: A.L. Patterson, Inc., Fairless Hills, PA (US)

( * ) Notice: Subject to any disclaimer, the term of this patent is extended or adjusted under 35 U.S.C. 154(b) by 0 days.

(21) Appl. No.: 14/456,108

(22) Filed: Aug. 11, 2014

Related U.S. Application Data

(63) Continuation-in-part of application No. 14/039,176, filed on Sep. 27, 2013, now Pat. No. 8,800,220, and a continuation-in-part of application No. 14/039,184, filed on Sep. 27, 2013, now Pat. No. 8,898,964.

(60) Provisional application No. 61/707,461, filed on Sep. 28, 2012, provisional application No. 61/706,282, filed on Sep. 27, 2012.

(51) Int. Cl.
*E04G 15/04* (2006.01)
*E04G 21/14* (2006.01)
(Continued)

(52) U.S. Cl.
CPC ..... *E04G 21/142* (2013.01); *B28B 23/005* (2013.01); *E04B 1/41* (2013.01); *E04G 15/04* (2013.01)

(58) Field of Classification Search
CPC ..... E04B 1/4121; E04B 1/38; E04B 1/41; E04G 21/142; B22C 9/06; B28B 23/005
USPC ..... 52/125.4, 125.5, 576, 699, 701, 98, 52/100; 249/91, 94, 96
See application file for complete search history.

(56) References Cited

U.S. PATENT DOCUMENTS 2,794,336 A * 6/1957 Ballou ..... 52/705
2,838,821 A 6/1958 Shur
(Continued)

FOREIGN PATENT DOCUMENTS

AU 2009217422 A1 4/2010
DE 3733703 A1 * 4/1989 ..... B28B 7/16
(Continued)

OTHER PUBLICATIONS

Walson Industrial Co., Limited; ARRF A-Anchor rubber recess former; http://www.walson.biz/pro_see.asp?nidn_rh393_34_54_dfd_46=67&xiaolei=778; 1 page; Copyright 2009; Shanghai, China.
(Continued)

*Primary Examiner* — Robert Canfield
*Assistant Examiner* — Babajide Demuren
(74) *Attorney, Agent, or Firm* — McGarry Bair PC

(57) ABSTRACT

A lift anchor assembly for a precast Portland cement concrete shape comprises a recess insert, a bilaterally symmetrical lift anchor, and an elongate triangular space. The recess insert is characterized by a longitudinal plane of symmetry, and is separable along a break line extending perpendicular to the longitudinal plane of symmetry into a pair of quadrant-shaped bodies, each characterized with a planar obverse wall. The bilaterally symmetrical lift anchor is characterized by a longitudinal axis of symmetry coextensive with the longitudinal plane of symmetry, and is immovably sandwiched between the quadrant-shaped bodies. The elongate triangular space is formed beneath the break line and extends orthogonal to the longitudinal plane of symmetry. A force applied to the break line toward the elongate triangular space will urge the quadrant-shaped bodies into rotation out of the Portland cement concrete.

18 Claims, 9 Drawing Sheets

(51) Int. Cl.
*E04B 1/41* (2006.01)
*B28B 23/00* (2006.01)

(56) References Cited

U.S. PATENT DOCUMENTS

| | | | | | |
|---|---|---|---|---|---|
| 4,627,198 | A | * | 12/1986 | Francies, III | 52/125.5 |
| 4,821,994 | A | | 4/1989 | Fricker | |
| 4,866,903 | A | * | 9/1989 | Ferstay | 52/677 |
| 5,829,207 | A | * | 11/1998 | Mackay Sim et al. | 52/125.4 |
| 6,082,700 | A | | 7/2000 | Lancelot, III et al. | |
| 6,095,483 | A | | 8/2000 | Mackay Sim et al. | |
| 6,460,824 | B1 | | 10/2002 | Lancelot, III et al. | |
| 6,575,424 | B2 | | 6/2003 | Domizio | |
| 6,769,663 | B2 | | 8/2004 | Kelly et al. | |
| 7,127,859 | B2 | | 10/2006 | Domizio | |
| D559,499 | S | | 1/2008 | Scott et al. | |
| 8,402,701 | B2 | * | 3/2013 | Arteon | 52/125.2 |
| 8,667,746 | B1 | * | 3/2014 | Francies, III | 52/125.4 |
| 2002/0134905 | A1 | | 9/2002 | Domizio | |
| 2002/0195537 | A1 | | 12/2002 | Kelly et al. | |
| 2003/0110715 | A1 | * | 6/2003 | Hansort | 52/125.6 |
| 2003/0208968 | A1 | * | 11/2003 | Lancelot et al. | 52/125.4 |
| 2008/0196324 | A1 | | 8/2008 | Mackay Sim | |
| 2008/0203270 | A1 | | 8/2008 | Connell et al. | |
| 2009/0183441 | A1 | | 7/2009 | Azarin | |
| 2009/0308005 | A1 | * | 12/2009 | Ireland et al. | 52/250 |
| 2011/0191990 | A1 | | 8/2011 | Beaulieu | |

FOREIGN PATENT DOCUMENTS

| | | | | |
|---|---|---|---|---|
| DE | 10116673 | A1 * | 10/2002 | E04G 21/14 |
| WO | 2012140329 | A1 | 10/2012 | |

OTHER PUBLICATIONS

Dayton Superior Corporation; product manual; p. 84 (1 page); Utility Anchor System; Miamiburg, Ohio, USA.

MeadowBurke Precast Products Manual, Rapid Lift System Anchors; 1 page; www.MeadowBurke.com; Tampa, Florida, USA.

* cited by examiner

PRECAST CONCRETE LIFT ANCHOR ASSEMBLY

CROSS-REFERENCE TO RELATED APPLICATIONS

This application is a continuation-in-part of U.S. application Ser. No. 14/039,176, filed Sep. 27, 2013, now U.S. Pat. No. 8,800,220, which claims the benefit of U.S. provisional application Ser. No. 61/707,461, filed Sep. 28, 2012, and is a continuation-in-part of U.S. application Ser. No. 14/039,184, filed Sep. 27, 2013, now U.S. Pat. No. 8,898,764, which claims the benefit of U.S. provisional application Ser. No. 61/706,282, filed Sep. 27, 2012, each of which application is incorporated by reference herein in its entirety.

BACKGROUND OF THE INVENTION

The invention may relate generally to a precast concrete lift anchor assembly for precast Portland cement concrete shapes. In another aspect, the invention may relate to a recess insert for forming a cavity in Portland cement concrete. In another aspect, the invention may relate to a concrete lift anchor partially embeddable in Portland cement concrete, joined with a pair of complementary recess insert parts for forming a cavity in Portland cement concrete, to enable access to an unembedded portion of the lift anchor for coupling with a lifting apparatus.

It is known to utilize precast Portland cement concrete shapes for installation on a construction project. Such shapes may be very heavy, which may necessitate the use of specialized equipment, such as cranes, helicopters, cables, chains, hooks, clutches, and the like, for safe lifting, moving, and installation.

Concrete shapes may be cast with integral metal lift anchors, to which hooks, cables, chains, and the like, may be attached for facilitating the handling of the concrete shapes. Such metal lift anchors may be heavy, large, and unwieldy. Their configuration may complicate the placement of reinforcing steel and prestressing strands, contributing to increased time and costs, and potentially increasing the risk of reinforcement and pre-stressing selection and installations failing to meet established or required standards. This may be due, in part, to preoccupation by a construction contractor or engineer with optimizing the balance between the load capacity of a lift anchor, and its cost and utility.

The lift anchor may be located within the concrete shape adjacent known prestressing strands. Factors such as the dimensions of the concrete shape, the designed location for the lift anchor within the concrete shape, the required number of lift anchors, the required number of prestressing strands, and the like, may control the spatial relationship of the lift anchor and the prestressing strands. This may result in undesirable crowding of the lift anchor and the prestressing strands. It may be necessary to reconfigure the lift anchor and/or prestressing strands due to concrete dimensions, such as insufficient concrete cover adjacent the lift anchor, prestressing strands, and/or other reinforcement. Reconfiguration may be complicated with prior art lift anchors, for example those that are fabricated as single piece, that incorporate lower strength materials or configurations, or that require additional components, such as ties, for attaching the lift anchor to prestressing strands and/or other reinforcement.

The lift anchor may be coupled with a recess insert configured to isolate the exposed portion from the adjacent concrete. As fresh concrete is placed, the recess insert may prevent contact of the concrete with the exposed portion of the lift anchor. When the concrete has cured, the recess insert may be disassembled, leaving the lift anchor partly embedded in the concrete, and partly exposed for connecting hooks, cables, chains, and other lifting and transporting equipment. Selection of a recess insert and lift anchor, and the number and location of lift anchors, may be finalized relatively early in the design phase. Last-minute modifications to or substitution for a pre-selected lift anchor may be complicated, untimely, and costly.

A lift anchor and recess insert that has a high strength-to-size ratio, is compact, can readily accommodate different loading configurations, and comprises a relatively straightforward manufacture, is desirable.

BRIEF DESCRIPTION OF THE INVENTION

A lift anchor assembly for a precast Portland cement concrete shape comprises a recess insert, a bilaterally symmetrical lift anchor, and an elongate triangular space. The recess insert is characterized by a longitudinal plane of symmetry, and is separable along a break line extending perpendicular to the longitudinal plane of symmetry into a pair of quadrant-shaped bodies, each characterized with a planar obverse wall. The bilaterally symmetrical lift anchor is characterized by a longitudinal axis of symmetry coextensive with the longitudinal plane of symmetry, and is immovably sandwiched between the quadrant-shaped bodies. The elongate triangular space is formed beneath the break line and extends orthogonal to the longitudinal plane of symmetry. A force applied to the break line toward the elongate triangular space will urge the quadrant-shaped bodies into rotation out of the Portland cement concrete.

DETAILED DESCRIPTION OF EMBODIMENTS OF THE INVENTION

As may be used herein, the following terms have the associated definitions unless otherwise indicated:

"Axis of symmetry" means "a real or imaginary straight line about which a three-dimensional body is symmetrical or nominally symmetrical."

"Longitudinal" with respect to a three-dimensional body means "correlating with the longest axis of a three-dimensional body."

"Plane of symmetry" means "a real or imaginary plane that divides a three-dimensional body such that each side of the plane is a mirror image of the other."

The invention may be described herein in the context of exemplary embodiments, two or more of which may share features and functionalities. A subsequent description of a prior detailed description of shared features and functionalities herein may be omitted except as necessary for a complete understanding of the embodiments. It should be noted that one or more exemplary embodiments of the invention in the form of Portland cement concrete recess inserts and lift anchor assemblies may have applicability in an environment different than that described herein, and that the invention may be realized in other than the disclosed exemplary embodiments. Such embodiments may not be construed as limiting the scope of the claims.

Figure 1:
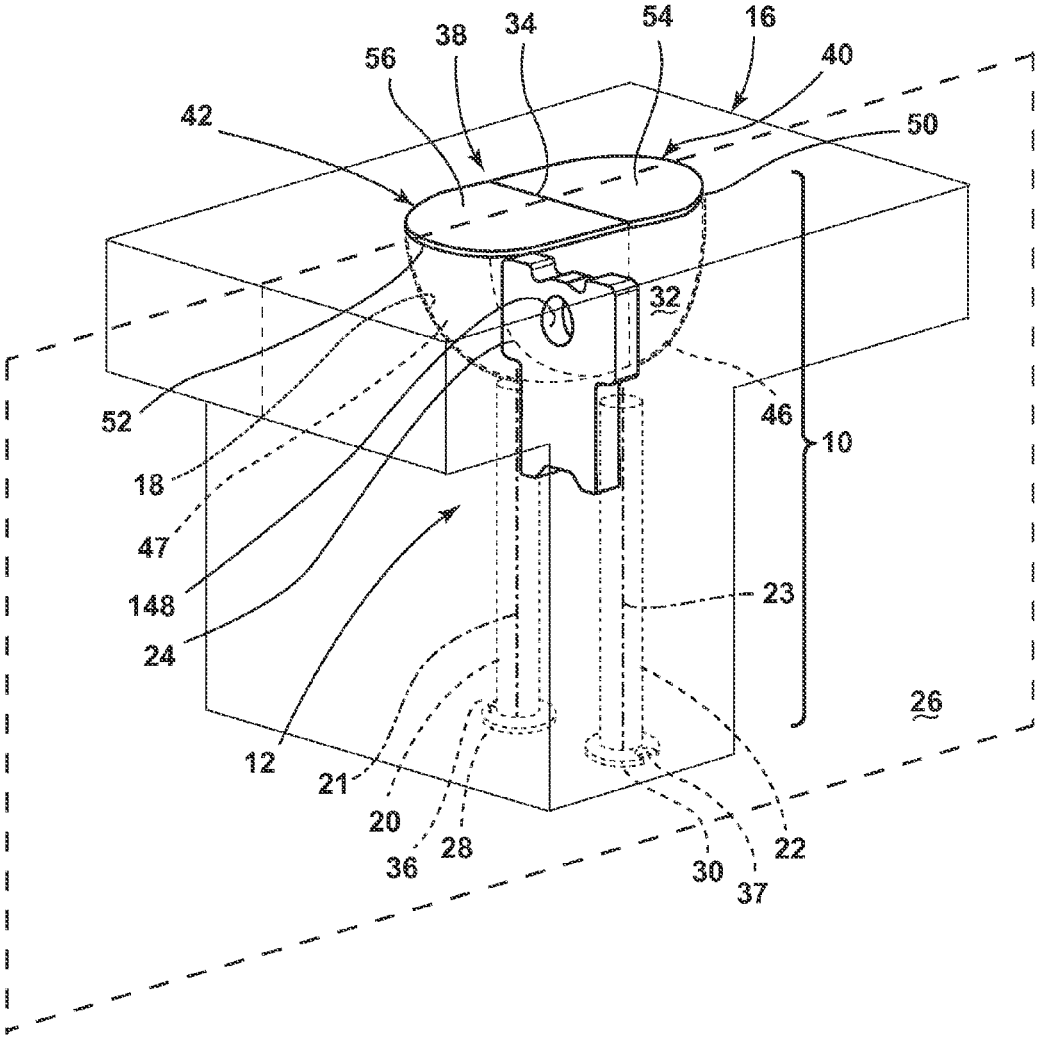
FIG. 1 is a perspective view of a precast Portland cement concrete lift anchor assembly incorporated into a precast, prestressed Portland cement concrete tee according to a first exemplary embodiment of the invention.

Referring now to the figures, and to FIG. 1 in particular, an exemplary first embodiment according to the invention of a precast Portland cement concrete lift anchor assembly 10 is illustrated embedded in an exemplary precast Portland cement concrete tee 16. The precast concrete lift anchor assembly 10 may include a lift anchor 12, and a first embodiment recess insert 38. The lift anchor 12 may comprise an elongate first anchor leg 20 and an elongate second anchor leg 22 fixedly coupled in parallel disposition with a lift anchor head 24. For purposes of example, the first embodiment precast Portland cement concrete lift anchor assembly 10 may be described and illustrated with respect to the lift anchor 12 described in detail hereinafter, notwithstanding embodiments with lift anchors having alternative configurations may be utilized. It may be understood that such alternative configurations may necessitate modifications to the portions of the recess insert 38 in contact with the lift anchor 12.

Moreover, recess inserts having alternative configurations to provide and/or accommodate alternative features and/or functionalities may be utilized with the lift anchor 12 or with lift anchors having alternative configurations. An embodiment described and/or illustrated herein that may be characterized by a lift anchor and recess insert having a selected configuration may not be construed as limiting the scope of the claims.

The first anchor leg 20 may be a cylindrical rod-like member characterized by a first longitudinal axis 21, a first proximal end 92, and an opposed first distal end 94. The second anchor leg 22 may be a cylindrical rod-like member characterized by a second longitudinal axis 23, a second proximal end 96, and an opposed second distal end 98. The first distal end 94 may terminate in a first forged anchor foot 28, and the second distal end 98 may terminate in a second forged anchor foot 30. The anchor legs 20, 22 may be fabricated of a material capable of being forged, and having sufficient strength and durability for the purposes described herein, examples of which may include iron or steel.

The concrete lift anchor assembly 10 may be characterized by a longitudinal plane of symmetry 26 extending parallel to and equidistant from the first and second longitudinal axes 21, 23, and dividing the concrete lift anchor assembly 10 into two mirror images. The recess insert 38 may form a lift anchor recess 18 in the concrete shape 16, defining a lift anchor cavity 32 in which the lift anchor head 24 is exposed and accessible for connecting of lifting equipment (not shown).

Figure 2:
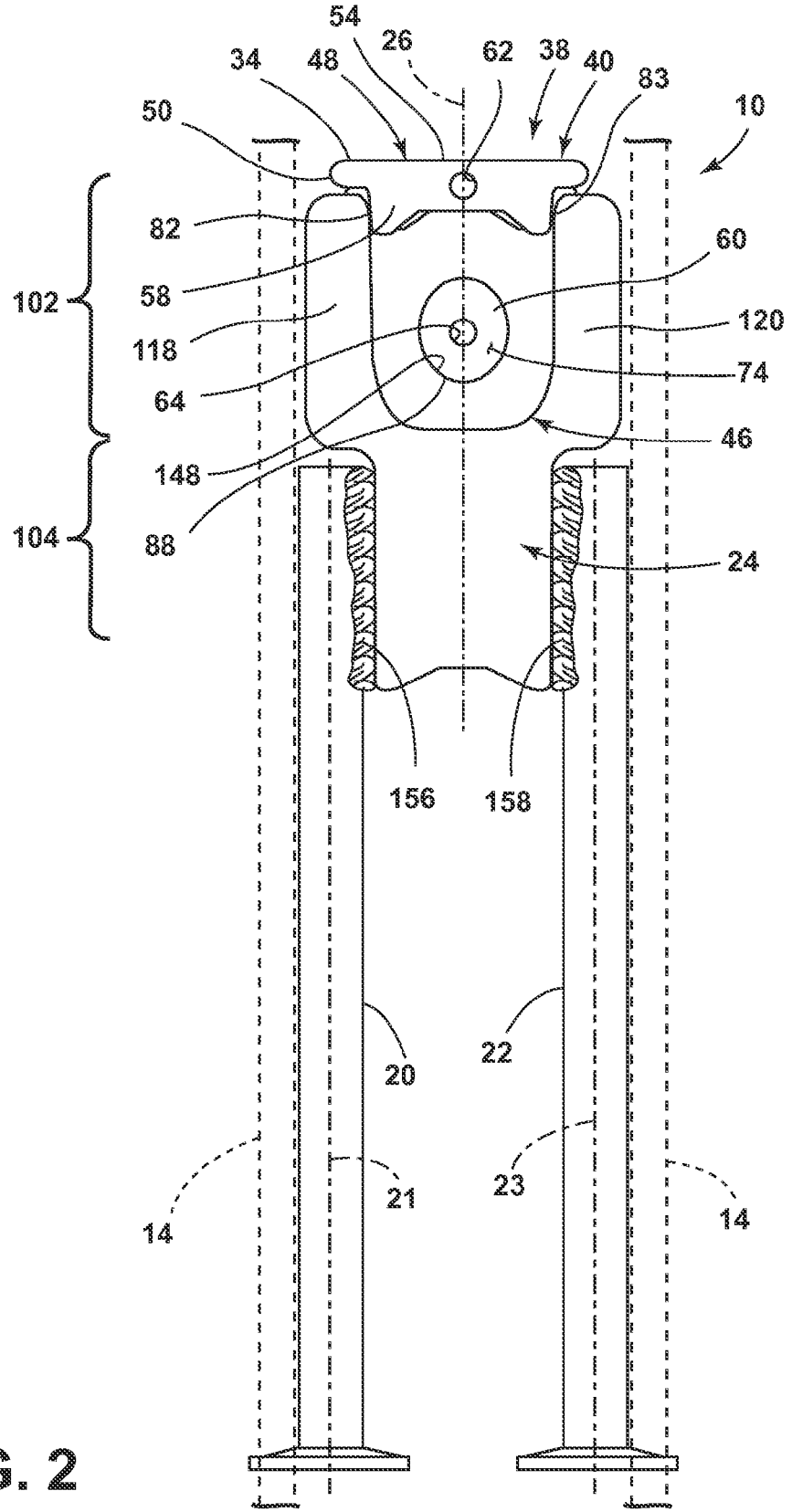
FIG. 2 is a front elevation view of the lift anchor illustrated in FIG. 1 showing the relative configurations and placement of a recess insert, prestressing strands, a lift anchor head, and two anchor legs.

Referring to FIG. 2, the recess insert 38 may intersect the upper center portion of the lift anchor head 24 so that it is bisected by the plane of symmetry 26. The lift anchor recess 18, and lift anchor cavity 32, may be bisected by the longitudinal plane of symmetry 26. A pair of pre-stressing strands 14 may extend parallel to and immediately adjacent the lift anchor legs 20, 22.

Figure 3:
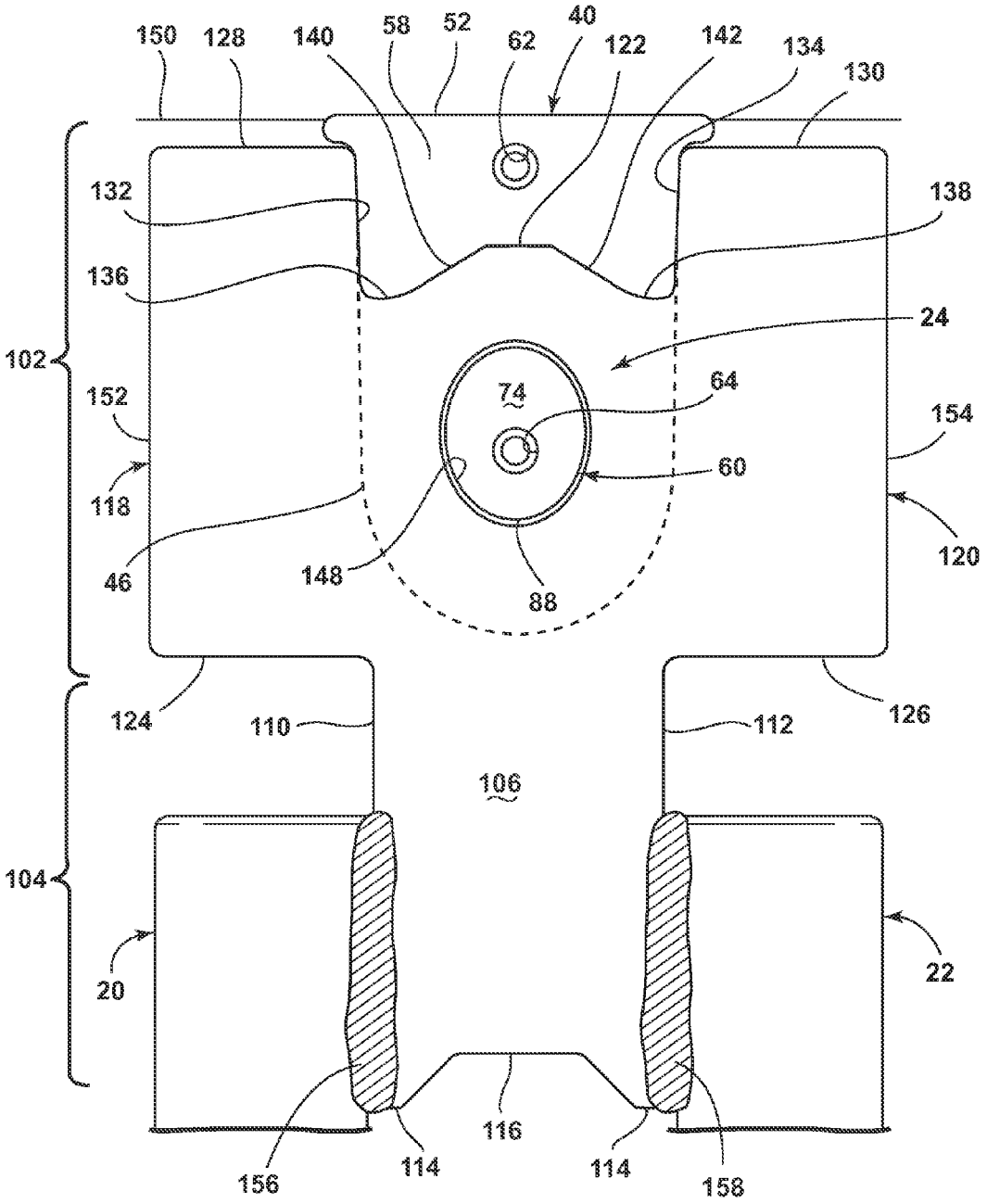
FIG. 3 is an enlarged front elevation view of the lift anchor head, recess insert, and portions of the two anchor legs, illustrated in FIG. 2.
Figure 4:
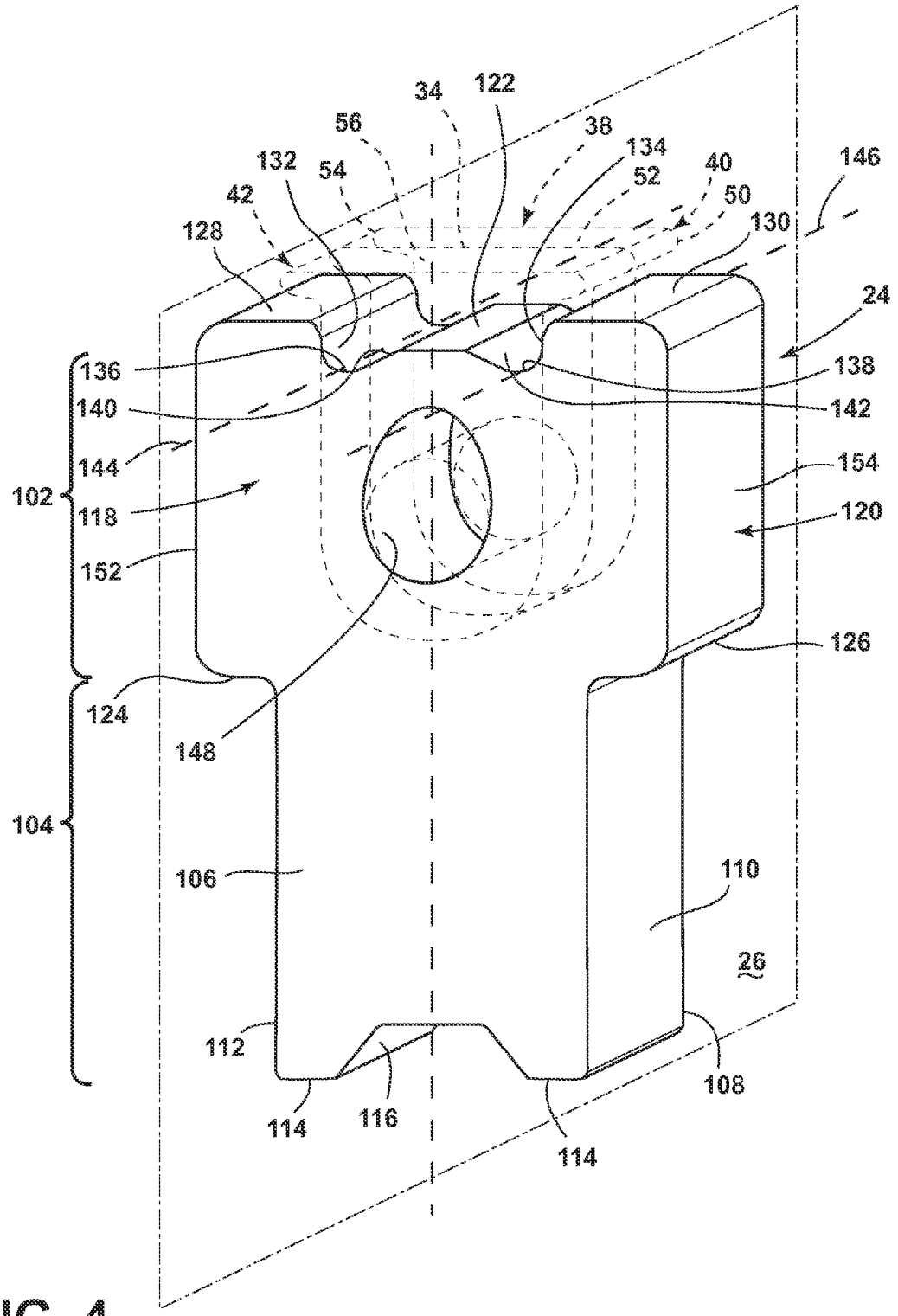
FIG. 4 is a perspective view of the lift anchor head illustrated in FIG. 2 oriented with a longitudinal plane of symmetry, with portions of the recess insert shown in broken lines for purposes of clarity.

Referring also to FIGS. 3 and 4, the lift anchor head 24 may comprise a bilaterally symmetrical body characterized by the longitudinal plane of symmetry 26. The lift anchor head 24 may be somewhat T-shaped, comprising a generally rectangular lifting end 102 and an opposed generally rectangular anchor leg end 104. The lift anchor head 24 may be characterized by a uniform thickness, including a first planar sidewall 110, and an opposed parallel planar sidewall 112, each orthogonally disposed with a first planar contact face 106, and an opposed parallel second planar contact face 108. The lifting end 102 may include a contact pier opening 148 extending from the first contact face 106 to the second contact face 108. The contact pier opening 148 may be configured to connect the lift anchor head 24 with a lifting apparatus, such as a hook, a clutch, a carabiner, and the like, and may be circular, oval, a stadium or discorectangle, or another suitable shape. The contact pier opening 148 is illustrated for purposes of exemplification as having an oval shape.

Each sidewall 110, 112 may transition orthogonally to a planar distal embedment wall 124, 126, respectively, thence orthogonally from the distal embedment wall 124, 126 to a planar ear lateral wall 152, 154, respectively, thence orthogonally from the ear lateral wall 152, 154 to a planar proximal embedment wall 128, 130 respectively. Each proximal embedment wall 128, 130 may transition orthogonally to a depending opposed inward facing planar ear vertical wall 132, 134, respectively, thereby defining a generally rectangular outwardly disposed ear 118, 120, respectively.

The ears 118, 120 may be symmetrically disposed on either side of the plane of symmetry 26, separated from the plane of symmetry 26 by first and second trough-like concave channel walls 136, 138, respectively. Each channel wall 136, 138 may be characterized by a longitudinal axis 144, 146, respectively, each parallel to, and equally spaced away from, the longitudinal plane of symmetry 26. The channel walls 136, 138 may each transition to an upwardly inclined wall 140, 142, respectively, each inclined wall 140, 142 transitioning to a horizontal planar raised central wall 122, to define a center boss 160 having the general shape of a truncated isosceles triangle. The lift anchor head 24 may be fabricated of a material having sufficient strength and durability for the purposes described herein, examples of which may include iron or steel. The outline of the center boss 160 may follow the curvature of the contact pier opening 148 so that the opening 148 may be surrounded by a sufficient dimension of anchor head material to provided sufficient load capacity during lifting operations. The lift anchor head 24 may be dimensioned for developing a suitable load capacity for the purposes described herein consistent with the properties of the material from which the lift anchor head 24 may be fabricated.

The embedment walls, ear vertical walls, concave channel walls, and inclined walls may be symmetrically disposed about the plane of symmetry 26. The central wall 122 may be orthogonally bisected by the plane of symmetry 26.

Referring again to FIG. 2, each anchor leg 20, 22 may comprise an elongate circular steel rod-like member characterized by a longitudinal axis 21, 23, respectively, terminating in a circular forged foot 28, 30, respectively, disposed orthogonally to the longitudinal axis 21, 23 of the anchor leg 20, 22, respectively. Each anchor leg 20, 22 may be rigidly coupled with the lift anchor head 24 in a suitable manner, such as by welding.

Referring again to FIG. 3, as an example, the proximal end 92, 96 of each anchor leg 20, 22, respectively, may be coupled with each sidewall 110, 112, respectively, by a weld 156, 158, respectively, having sufficient strength and durability for the purposes described herein. The weldment may include the side walls 110, 112, portions of the contact faces 106, 108, and portions of the bottom wall 114. Each anchor leg 20, 22 may be coupled with a sidewall 110, 112, respectively, to leave a gap between the proximal end 92, 96, respectively, of the anchor leg 20, 22, respectively, and the distal embedment wall 124, 126, respectively, of each ear 118, 120, respectively, to accommodate a shear bar, as hereinafter described.

Each anchor foot 28, 30 may include an arcuate recess 36, 37, respectively, of a sufficient diameter to accommodate a pre-stressing strand 14 to enable the prestressing strand 14 to extend closely along an anchor leg 20, 22, respectively, and an adjacent ear 118, 120, respectively.

Figure 5A:
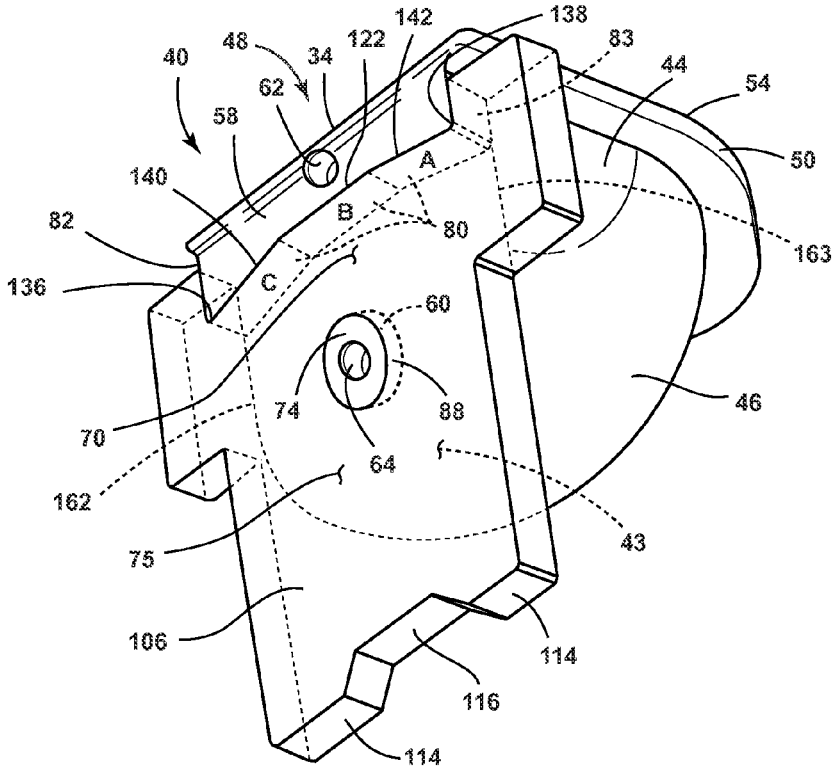
FIGS. 5A and 5B are perspective views of a matched pair of recess insert quadrants comprising the recess insert illustrated in FIG. 1, with the lift anchor head positioned for engagement with the matched pair.
Figure 5B:
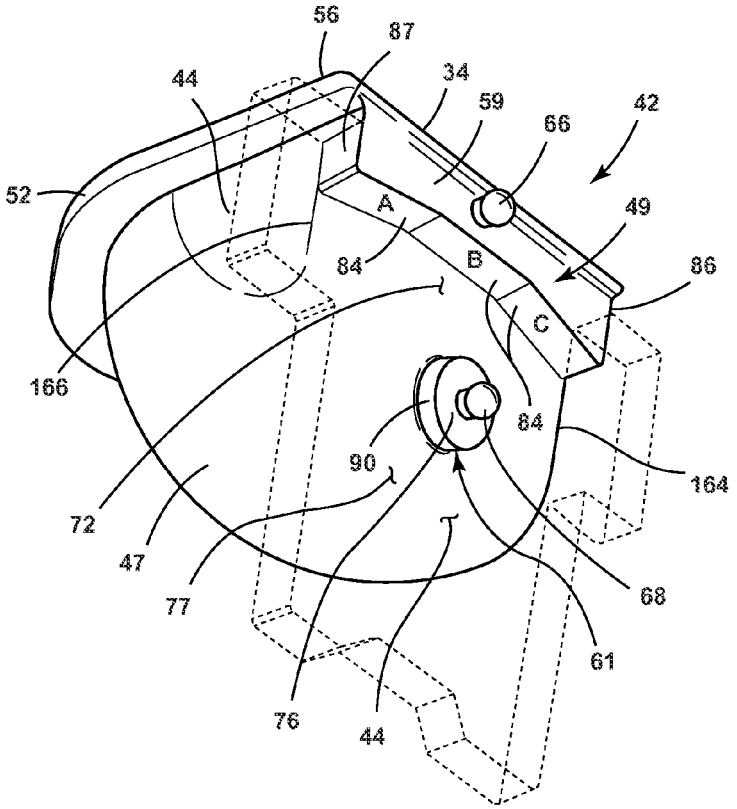
Figure 6:
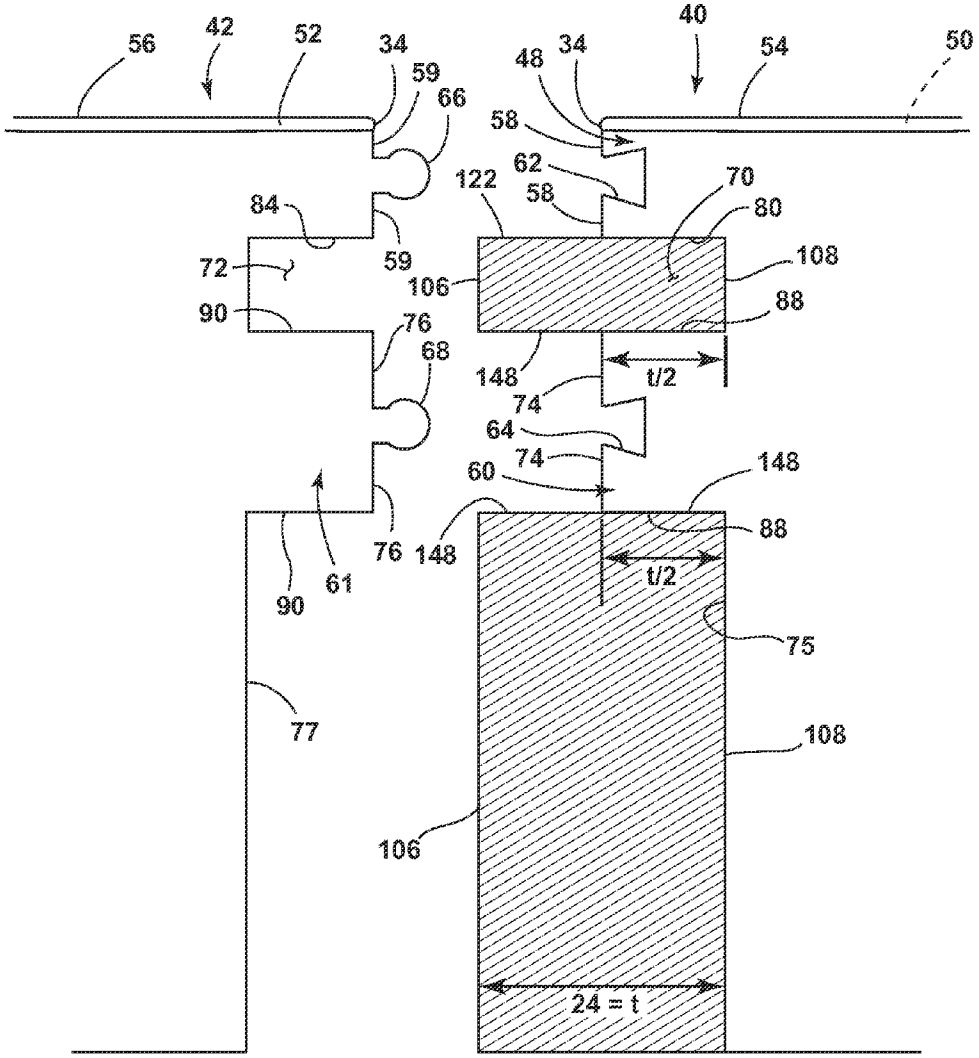
FIG. 6 is an enlarged sectional view taken along the longitudinal plane of symmetry illustrated in FIG. 4, of a portion of the recess insert quadrants and lift anchor head illustrated in FIGS. 5A and 5B aligned for collective joining.

Referring now to FIGS. 5A, 5B, and 6, an exemplary first embodiment according to the invention of a recess insert 38 may comprise a pair of somewhat quadrant-shaped bodies, i.e. a first recess insert quadrant 40 and a second recess insert quadrant 42. The first quadrant 40 may be characterized by a first planar obverse wall 54, a first lift anchor head engagement wall 43, and a first convex curved wall 46. The first lift anchor head engagement wall 43 may be characterized by a first contact pedestal 48, and a first contact pier 60. The second quadrant 42 may be characterized by a second planar obverse wall 56, a second lift anchor head engagement wall 44, and a second convex curved wall 47. The second lift anchor head engagement wall 44 may be characterized by a second contact pedestal 49, and a second contact pier 61. Each recess insert quadrant 40, 42 may be characterized by a closed exterior surface.

The first contact pedestal 48 may comprise a planar first pedestal contact wall 58 depending orthogonally from the first obverse wall 54 to a planar first lift anchor head channel 70. The first contact pier 60 may comprise a cylindrical body characterized by a circumferential first contact pier sidewall 88, and a planar first contact pier face 74. The first lift anchor head channel 70 may be bilaterally symmetrical relative to the longitudinal plane of symmetry 26, and may traverse the first quadrant 40 between the first contact pedestal 48 and the first contact pier 60, intersecting the first convex curved wall 46 along two laterally opposed intersection lines 162, 163. The first pedestal contact wall 58 may be co-planar with the first contact pier face 74.

The second contact pedestal 49 may comprise a planar second pedestal contact wall 59 depending orthogonally from the second obverse wall 56 to a planar second lift anchor head channel 72. The second contact pier 61 may comprise a cylindrical body characterized by a circumferential second contact pier sidewall 90, and a planar second contact pier face 76. The second lift anchor head channel 72 may be bilaterally symmetrical relative to the longitudinal plane of symmetry 26, and may traverse the second quadrant 42 between the second contact pedestal 49 and the second contact pier 61, intersecting the second convex curved wall 47 along two laterally opposed intersection lines 164, 166. The second pedestal contact wall 59 may be co-planar with the second contact pier face 76.

The obverse walls 54, 56 may transition orthogonally to the pedestal contact walls 58, 59, respectively, along a break line 34 orthogonal to the longitudinal plane of symmetry 26.

The first pedestal contact wall 58 may depend to the first lift anchor head channel 70 through a first contact pedestal segmented wall 80 orthogonal to the first pedestal contact wall 58 and the first lift anchor head channel 70. The first contact pedestal segmented wall 80 may terminate at one end in a first contact pedestal first sidewall 82 and at the other end in a parallel planar opposed first contact pedestal second sidewall 83. The first lift anchor head channel 70 may transition to a co-planar first anchor head contact face 75 intersecting the first convex curved wall 46. The second pedestal contact wall 59 may depend to the second lift anchor head channel 72 through a second contact pedestal segmented wall 84 orthogonal to the second pedestal contact wall 59 and the second lift anchor head channel 72. The second contact pedestal segmented wall 84 may terminate at one end in a second contact pedestal first sidewall 86 and at the other end in a parallel planar opposed second contact pedestal second sidewall 87. The second lift anchor head channel 72 may transition to a co-planar second anchor head contact face 77 intersecting the second convex curved wall 47.

The first contact pedestal segmented wall 80 may be nonlinear, and characterized by a plurality of planar wall segments, e.g. a first wall segment 80A, a middle wall segment 80B, and a third wall segment 80C. The second contact pedestal segmented wall 84 may be nonlinear, and characterized by a plurality of planar wall segments, e.g. a first wall segment 84C, a middle wall segment 84B, and a third wall segment 84A. Joining the first quadrant-shaped portion 40 into aligned contact with the second quadrant-shaped portion 42 may form a segmented wall, i.e. 80A/84A, 80B/84B, 80C/84C, in which the paired segments are co-planar. Alternatively, the segmented walls 80, 84 may be characterized as continuous curved walls having an identical curvature.

The planar obverse walls 54, 56 may extend laterally of the longitudinal plane of symmetry 26 and the convex curved walls 46, 47 to define a perimetric flange comprised of a first half-flange 50, and a second half-flange 52, respectively. The intersection of the convex curved walls 46, 47 with the underside of the perimetric flange 50, 52, respectively, may define a first continuous curve radially disposed relative to the intersection of the break line 34 and the longitudinal plane of symmetry 26. The intersection of the convex curved wall 46, 47 with the lift anchor head engagement wall 43, 44, respectively, may define a second continuous curve radially disposed relative to the intersection of the break line 34 and the longitudinal plane of symmetry 26, with the first continuous curve orthogonal to the second continuous curve.

A pair of somewhat quadrant-shaped planar sidewalls 78 may transition from the convex curved wall 46, 47 to orthogonally intersect the obverse wall 54, 56, respectively, and the lift anchor head engagement wall 43, 44, respectively. The incorporation of planar sidewalls 78 with the convex curved wall 46, 47 may thereby reduce the width of the recess insert 38.

The longitudinal plane of symmetry 26 may be oriented orthogonal to the pedestal contact walls 58, 59, the contact pier faces 74, 76, the lift anchor head channels 70, 72, and the anchor head contact faces 75, 77, and parallel to the planar sidewalls 78. The longitudinal plane of symmetry 26 may intersect the obverse walls 54, 56 at their furthest point from the break line 34.

A portion of the first pedestal contact wall 58 between the first obverse wall 54 and the middle segment 80B of the first contact pedestal segmented wall 80 may include a first opening 62 extending orthogonally into the first contact pedestal 48. The first contact pier 60 may include a second opening 64 extending coaxially into the first contact pier 60. A portion of the second pedestal contact wall 59 between the second obverse wall 56 and the middle segment 84B of the second contact pedestal segmented wall 84 may include a first spherical head fastener 66 extending orthogonally away from the second contact pedestal 49 for coaxial alignment with the first opening 62. The second contact pier 61 may include a second spherical head fastener 68 extending coaxially away from the second contact pier 61. The spherical head fasteners 66, 68 may be configured for alignment with the openings 62, 64 to hold the first quadrant 40 to the second quadrant 42. The openings 62, 64 and the spherical head fasteners 66, 68 may be bisected by the plane of symmetry 26. The spherical head fasteners 66, 68 may optionally be removable from the second quadrant 42 for seating into the openings 62, 64 in the first quadrant 40 so that the spherical head fasteners 66, 68 of the first quadrant 40 may be insertable into the openings 62, 64 in the second quadrant 42.

The openings 62, 64 and the spherical head fasteners 66, 68 may be adapted for frictional engagement. The spherical head fasteners 66, 68 may be fabricated of a material having a suitable strength, durability, and resilience for the purposes described herein, such as a nylon. The spherical head fasteners 66, 68 may accommodate wear, loss, or breakage, by enabling the ready removal and replacement of nonserviceable fasteners, thereby minimizing the frequency of disposal of the entire recess insert. Furthermore, the insert quadrants 40, 42 without the spherical head fasteners 66, 68 may have an identical configuration and, thus, may be fabricated using a single mold fixture or set of fixtures.

Referring specifically to FIG. 5A, the first quadrant 40 may be interlinked with the lift anchor head 24. The center wall 122 of the lift anchor head 24 may contact, or be adjacent, the middle wall segment 80B. The first inclined wall 140 of the lift anchor head 24 may contact, or be adjacent, the third wall segment 80C. The second inclined wall 142 may contact, or be adjacent, the first wall segment 80A. The first contact pier 60 may extend through the contact pier opening 148. Referring also to FIG. 6, the first lift anchor head engagement wall 43 may be configured so that the lift anchor head 24 may be received against the lift anchor head engagement wall 43 to a depth equal to ½ the thickness of the lift anchor head 24.

The second quadrant 42 may be aligned and brought into contact with the first quadrant 40 and the lift anchor head 24 so that the first opening 62 in the first contact pedestal 48 may receive the first spherical head fastener 66 extending from the second contact pedestal 49, and the second opening 64 in the first contact pier 60 may receive the second spherical head fastener 68 extending from the second contact pier 61. Concurrently, the lift anchor head 24 may be sandwiched between the first lift anchor head channel 70 and the second lift anchor head channel 72, and between the first anchor head contact face 75 and the second anchor head contact face 77. The obverse walls 54, 56 may be joined along the break line 34.

The lift anchor head 24 may be locked between the quadrants 40, 42, thereby minimizing movement of the lift anchor head 24 relative to the recess insert 38. When the recess insert quadrants 40, 42 may be joined together by inserting the spherical head fasteners 66, 68 into the openings 62, 64, respectively, the lift anchor head 24 may be tightly enveloped within the resulting cavity formed by the connected recess insert quadrants 40, 42.

The precast concrete lift anchor assembly 10, comprising the recess insert quadrants 40, 42 coupled together around the lift anchor head 24 and the anchor legs 20, 22 welded to the lift anchor head 24, may be installed in a precasting mold (not shown), along with prestressing strands and other reinforcement. Fresh concrete may be placed in the mold so that the perimetric flange 50, 52 may extend along, or sit upon, the surface of the concrete. After the concrete has cured, the recess insert quadrants 40, 42 may be removed from the lift anchor recess 18 by lifting the ends of the flanges 50, 52, thereby uncoupling the spherical head fasteners 66, 68 from the openings 62, 64, respectively, rotating the quadrants 40, 42 away from the lift anchor head 24 and out of the lift anchor recess 18, leaving the lift anchor head 24 partially exposed for coupling with lifting equipment.

It may be realized that fresh concrete and/or cement mortar may migrate around the recess insert 38 and between the quadrants 40, 42. Any fresh concrete residue, i.e. water, mortar, slurry, and the like, that may migrate between the quadrants 40, 42 may remain on or along the exterior surfaces of the quadrants 40, 42. However, such residue may be readily removed from the smooth exterior surfaces of the quadrants 40, 42 at the end of the concrete placement. Fabricating the quadrants 40, 42 in order to produce and maintain smooth convex curved walls 46, 47 may facilitate removal of the quadrants 40, 42 from the cured concrete, and residue from the quadrants 40, 42. The capacity to withstand high compressive loads, fracturing, generation of tensile forces, and abrasion from removal of the quadrants from the cured concrete, may be expected to be important properties in selecting a material from which the quadrants 40, 42 may be fabricated.

Figure 7A:
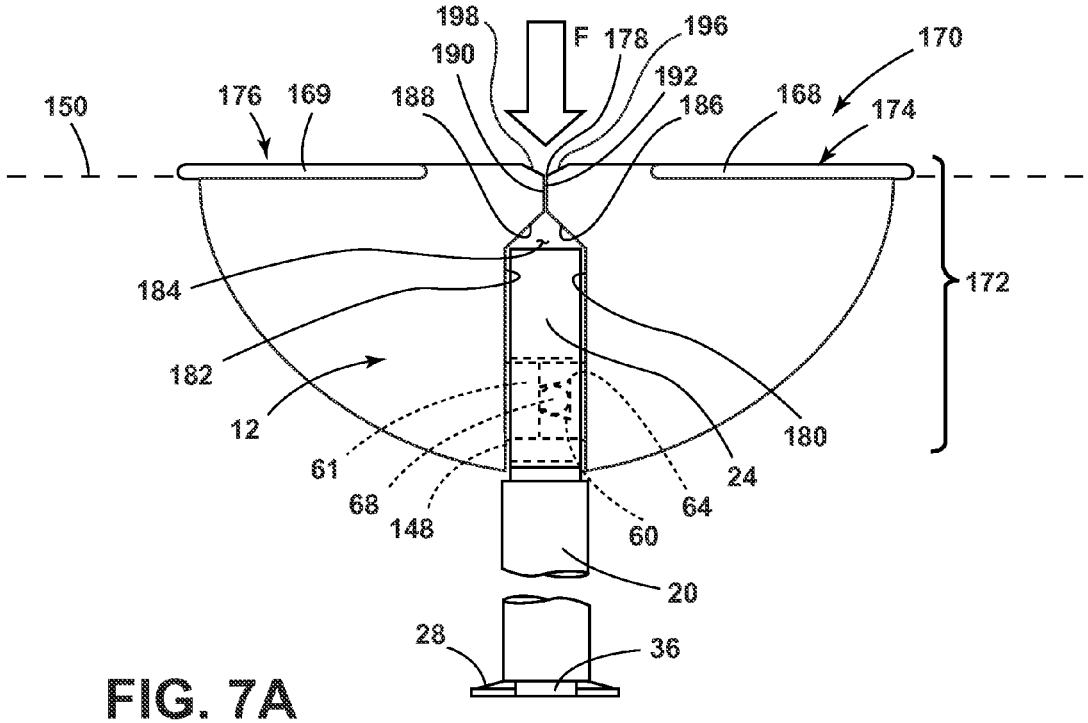
FIG. 7A is a side elevation view of a matched pair of recess insert quadrants engaged with the lift anchor according to a second exemplary embodiment of the invention.
Figure 7B:
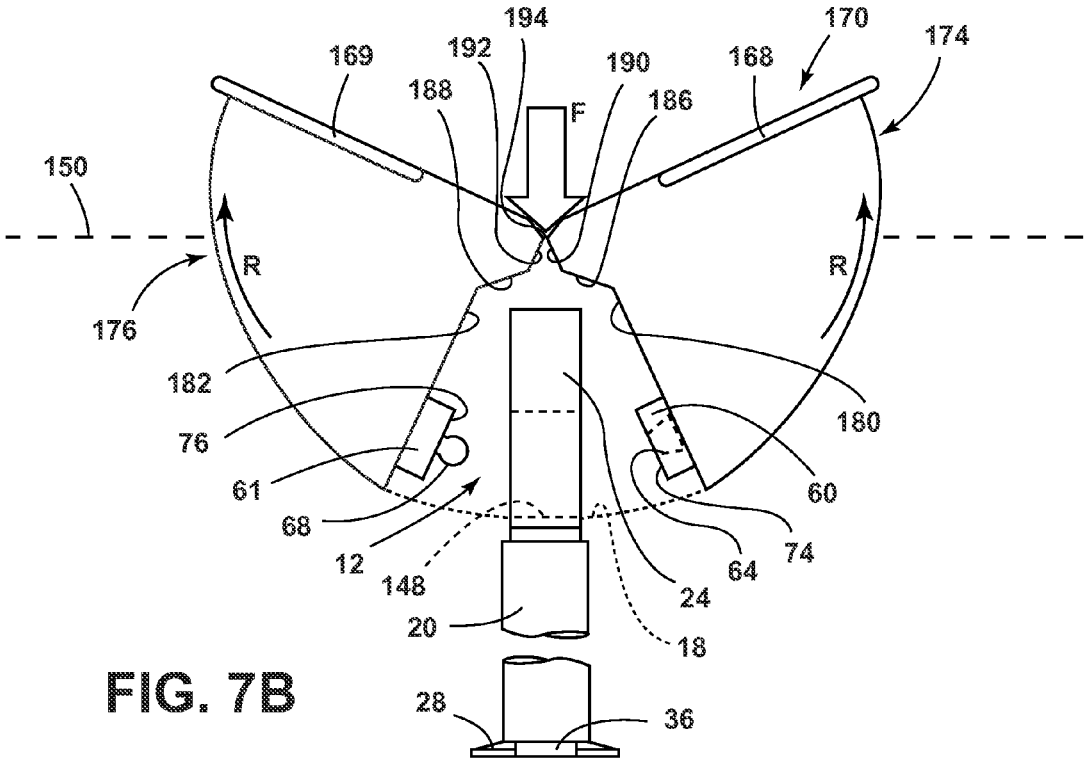
FIG. 7B is a side elevation view of the recess insert quadrants and lift anchor illustrated in FIG. 7A showing a means of removing the recess insert quadrants from engagement with the lift anchor, thereby leaving a lift anchor recess in the Portland cement concrete.
Figure 7C:
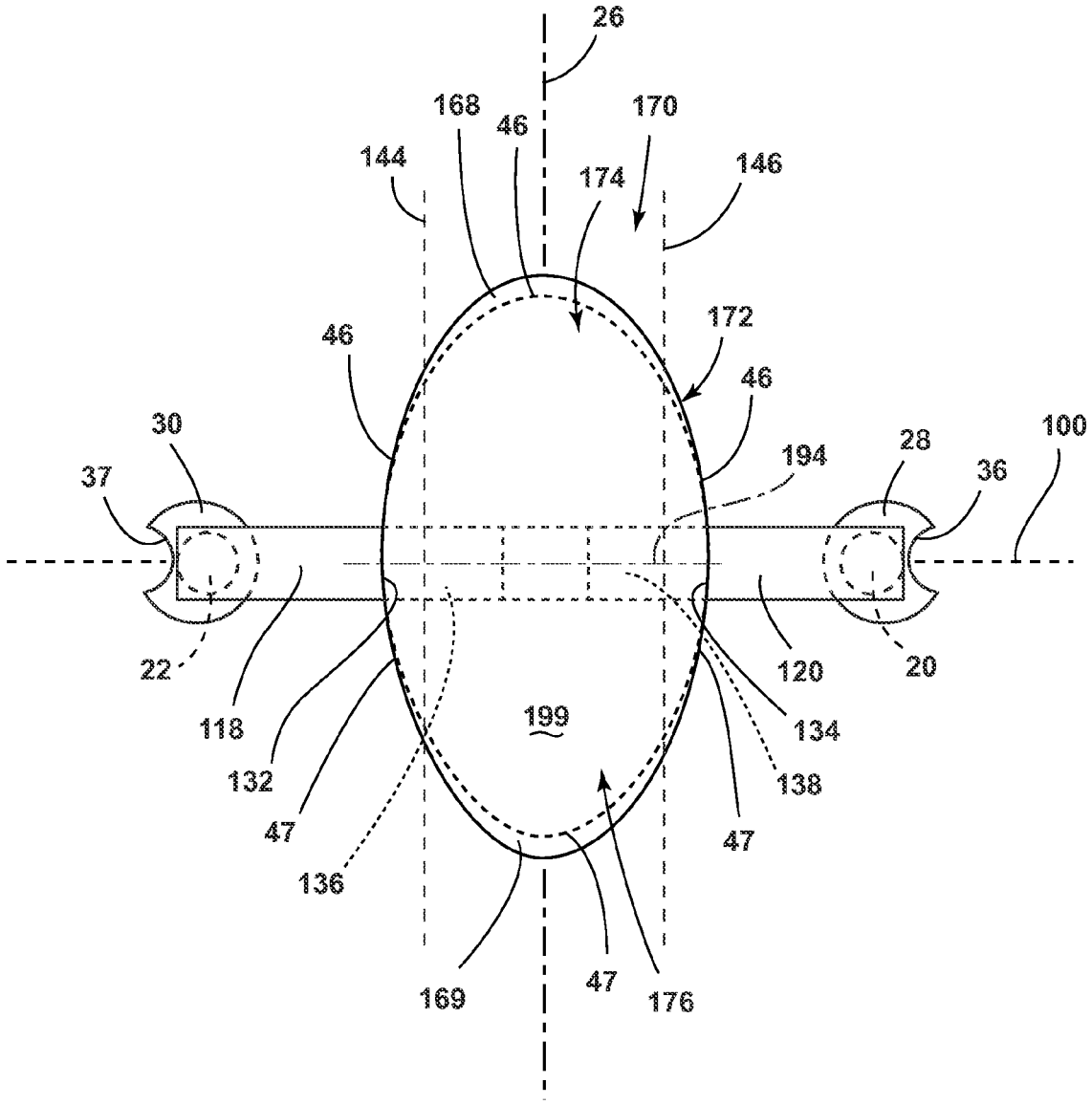
FIG. 7C is a plan view of the matched pair of recess insert quadrants engaged with the lift anchor illustrated in FIG. 7A.

Referring now to FIGS. 7A-7C, an exemplary second embodiment according to the invention of a precast Portland cement concrete lift anchor assembly 170 may share several features with the first embodiment precast Portland cement concrete lift anchor assembly 10, including a second embodiment recess insert 172 comprising a first quadrant-shaped portion 174 coupleable with a second quadrant-shaped portion 176, and the lift anchor 12. The quadrants 174, 176 may be characterized by sidewalls 78, convex curved walls 46, 47, and lift anchor head engagement walls 180, 182 (corresponding to walls 43, 44), as described hereinbefore. The first recess insert quadrant 174 may comprise a planar first obverse wall 196, and the second recess insert quadrant 176 may comprise a planar second obverse wall 198. The two quadrants 82, 84 may be coupleable together, as described hereinafter, to define a break line 178 extending orthogonally through the longitudinal plane of symmetry 26.

The quadrants 174, 176 may comprise lift anchor head engagement walls 180, 182 adapted for coupling with the lift anchor 12 in a manner generally identical to the coupling of the lift anchor head engagement walls 43, 44 with the lift anchor 12. As illustrated in FIG. 7B, the first lift anchor head engagement wall 180 may comprise a raised cylindrical first contact pier 60, and the second lift anchor head engagement wall 182 may comprise a raised cylindrical second contact pier 61, each pier 60, 61 in opposed, cooperative disposition with the other for insertion of the spherical head fastener 68 into the opening 64.

It may be recognized that the first obverse wall 196 may depend orthogonally along the break line 178 to a first contact wall 190, and the second obverse wall 198 may depend orthogonally along the break line 178 to a second contact wall 192. The transition from each obverse wall 196, 198 to a contact wall 190, 192, respectively, may be characterized as a chamfered edge, as illustrated in FIG. 7A, or a rounded edge. The first contact wall 190 may transition to a first inclined wall 186, and the second contact wall 192 may transition to a second inclined wall 188, so that coupling of the quadrants 82, 84 may define an elongate triangular space 184 extending the full width of the recess insert 172 along the uppermost wall of the lift anchor head 24, orthogonal to the plane of symmetry 26.

Alternatively, the recess insert 172 may be characterized by a first obverse wall 196 and a second obverse wall 198 joined into a consolidated obverse wall 199, as illustrated in FIG. 7C. A lateral plane of symmetry 100 may traverse the precast concrete lift anchor assembly 170 and the recess insert 172, orthogonal to the longitudinal plane of symmetry 26. The plane of symmetry 100 may define a rotation axis 194 (FIG. 7C) laterally traversing the consolidated obverse wall 199, corresponding with the break line 178. Thus, the quadrants 174, 176 may be coupled by the consolidated obverse wall 199 for relative rotation about the rotation axis 194, i.e. a living hinge, defined by the intersection of the plane of symmetry 100 with the consolidated obverse wall 199.

The recess insert 172 may be coupled with the lift anchor 12 as previously described herein so that the contact piers 60, 61 are joined, with the spherical head fastener 68 held in the second opening 64. This may be sufficient to retain the quadrant-shaped portions 174, 176 together and enclose the lift anchor 12. Alternatively, the consolidated obverse wall 199 may contribute to holding the contact walls 190, 192 together, in a manner similar to the coupling of the first spherical head fastener 66 with the first opening 62.

The recess insert 172 may reside in a Portland cement concrete precast shape during the period of time that the concrete may be curing. Referring again to FIGS. 7A and 7B, the obverse walls 196, 198 may rise above the surface 150 of the concrete. Referring again to FIG. 7C, the obverse walls 196, 198 may extend somewhat beyond the convex curved walls 46, 47, respectively, to define a first quadrant flange 168 and a second quadrant flange 169, respectively. The width of the quadrant flanges 168, 169 may vary from a maximum at the plane of symmetry 26 to a value of zero as the flanges 168, 169 approach the lateral plane of symmetry 100.

When the concrete has cured, the recess insert 172 may be removed from the concrete by exerting a force F to the obverse walls 196, 198 along the break line 178 toward the lift anchor 12. The force F may be applied in any suitable manner, such as with a hammer, the fingers, equipment capable of applying a force to a limited area, and the like. The force F may urge the contact walls 190, 192 toward the lift anchor. Concurrently, the quadrant-shaped portions 174, 176 may rotate about the rotation axis 194 along the lift anchor recess 18 to expose the exterior surfaces of the convex curved walls 46, 47, respectively. When the contact piers 60, 61 may separate from the lift anchor 12, the quadrant-shaped portions 174, 176 may be removed from the lift anchor recess 18.

The above sequence of steps may similarly enable removal of a recess insert 172 having a consolidated obverse wall 199. The effects of the force F applied to the recess insert 172 may be enhanced by inclining the obverse walls upwardly toward the break line 178. Thus, the force F may be applied to a ridge formed by the joining of the inclined obverse walls. It may be understood that a ridge may enable a greater displacement of the break line 178, or rotation axis 194, without contact with the lift anchor head 24.

Because a portion of the obverse walls adjacent the break line 178 may be urged toward the lift anchor recess 18 during removal of the recess insert 172, a flange continuing outwardly from the obverse walls 196, 198, 199 may be prevented from moving past the perimetric edge of the lift anchor recess 18. The flange must necessarily remain outside the lift anchor recess 18. This may be accommodated by eliminating the flange from the recess insert 172, thereby enabling movement of a portion of the recess insert 172 into the lift anchor recess 18. Alternatively, the quadrant flanges 168, 169 may be utilized along a portion of the obverse walls 196, 198, 199 that may remain outside the lift anchor recess 18 during the removal process. It may be anticipated that the portions of the quadrants 174, 176 along the break line 178 may move into the lift anchor recess 18, and portions of the flanges may be eliminated in these areas.

Figure 8:
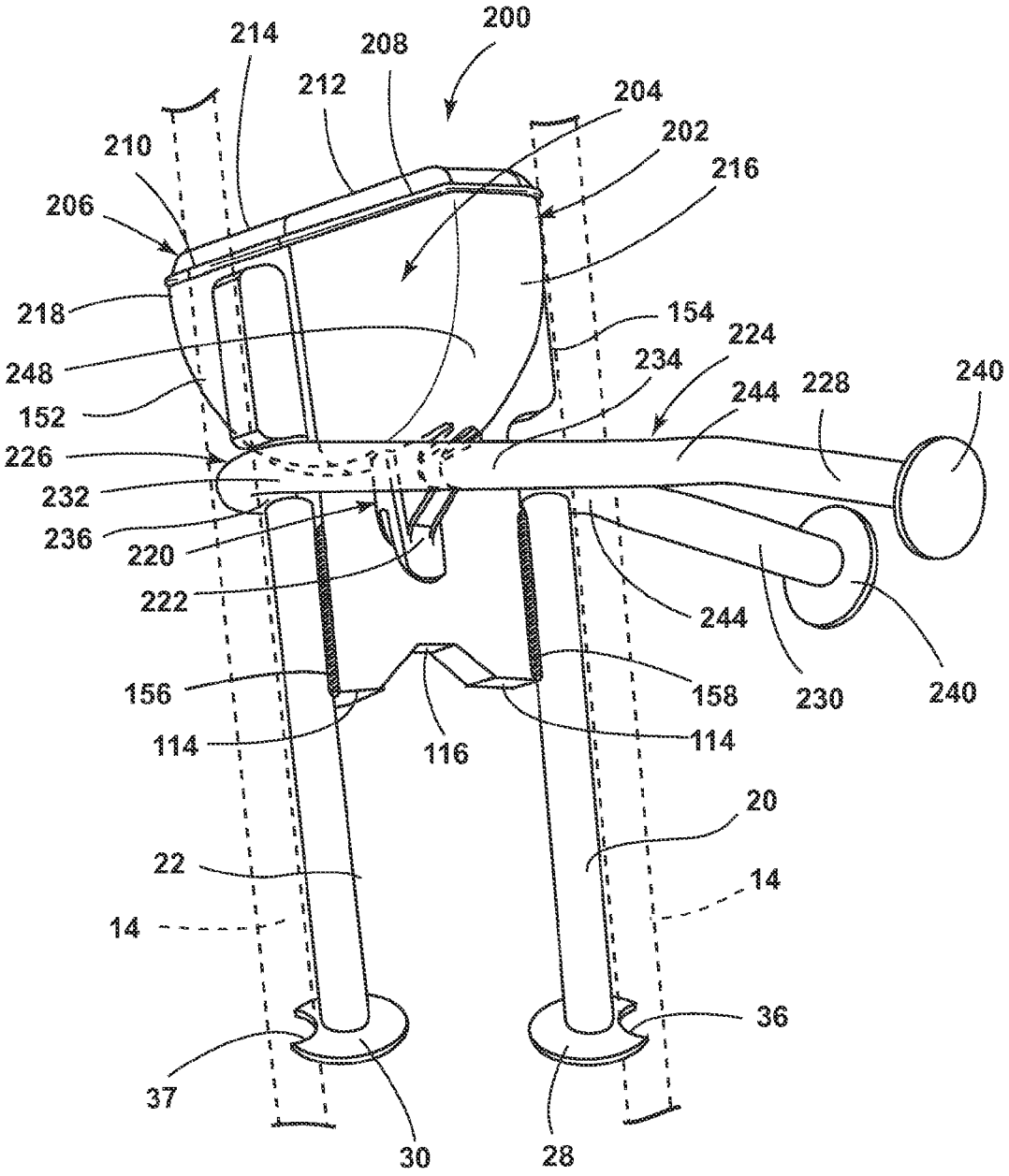
FIG. 8 is a perspective view of a recess insert, lift anchor, and shear bar according to a third exemplary embodiment of the invention

Referring now to FIG. 8, an exemplary third embodiment according to the invention of a precast Portland cement concrete lift anchor assembly 200 may share several features with the first and second embodiment precast Portland cement concrete lift anchor assemblies 10, 170, including a third embodiment recess insert 202, first and second circular quadrant-shaped portions 204, 206, and the lift anchor 12.

U.S. application Ser. No. 14/039,184, filed Sep. 27, 2013, entitled "Lift Anchor Assembly for Precast Portland Cement Concrete Shapes," describes subject matter that is shared with the herein described third embodiment precast concrete lift anchor assembly 200. Subject matter incorporated by reference herein may relate generally to the third embodiment recess insert 202, in particular the first and second circular quadrant-shaped portions 204, 206, and a pair of shear bar cradles 220, each opposedly attached to one of a pair of shear bar tabs 222 extending radially away from a first quadrant curved wall 216 and a second quadrant curved wall 218. Because U.S. application Ser. No. 14/039,184 is incorporated by reference, shared subject matter may not be described herein, except for the following.

The recess insert 202 may be characterized by the pair of circular quadrant-shaped portions 204, 206, and adapted to hold a lift anchor 12, and a divergent leg shear bar 224. The recess insert 202 may be coupled with the lift anchor 12, and the divergent leg shear bar 224 may be coupled with the recess insert 202 and, thus, with the lift anchor 12, as described hereinafter.

The divergent leg shear bar 224 may be characterized as an inverted generally U-shaped member comprising a U-shaped portion 226 transitioning to a pair of spaced-apart inclined legs 228, 230. The U-shaped portion 226 may be characterized as a bow 232 comprising a pair of parallel bow legs 234, 236. The bow legs 234, 236 may be characterized by a preselected bow leg spacing, and a leg bend length 236. Each inclined leg 228, 230 may terminate in a forged circular foot 240, 242, respectively. The bow legs 234, 236 may transition to the inclined legs 228, 230, respectively, through leg bends 244, 246, respectively. For example, the angle of inclination $\alpha$ of the inclined legs 228, 230 away from the bow legs 234, 236, respectively, may be approximately 17°. An exemplary divergent leg shear bar 224 may be fabricated of 14 mm (0.551") smooth surface round rod, and the forged feet 240, 242 may have a diameter of approximately 40 mm (1.575").

The recess insert 202 may be characterized as a hollow body having a clamshell configuration, comprising the first circular quadrant-shaped portion 204 and the second circular quadrant-shaped portion 206. The quadrant-shaped portions 204, 206 may each comprise a quadrant obverse wall 212, 214, respectively, a quadrant curved wall 216, 218, respectively, and a quadrant flange 282, 210, respectively. Each quadrant-shaped portion 204, 206 may also comprise a lift anchor head engagement wall similar to the hereinbefore described engagement walls 43, 44. Alternatively, engagement walls may be omitted from the quadrant-shaped portions 204, 206.

The quadrant-shaped portions 204, 206 may be separated bodies, or cooperatively attached along a hinge corresponding to the break line 178, or attached by a similar rotatable joint. When the two quadrant-shaped portions 204, 206 are closed around a lift anchor head 24, the recess insert 202 may be characterized a semicircular wall 248. The lifting end 102 of the lift anchor head 24 may be retained in an internal cavity (not shown) in the closed recess insert 202.

The quadrant-shaped portions 204, 206 may each comprise a shear bar tab 220 extending radially from the quadrant curved wall 216, 218 so that the shear bar tabs 220 may be aligned in parallel, with the lift anchor head 24 held between the shear bar tabs 220 when the quadrant-shaped portions 204, 206 may be assembled, which may be by rotation about the break line 34 into a closed configuration. The shear bar tabs 220 may be configured for opposed seating in a second opening in the lift anchor head 24 when the quadrant-shaped portions 204, 206 are in the closed configuration. This may provide enhanced resistance to movement of the lift anchor 12 relative to the recess insert 202. Each closure tab may comprise a shear bar cradle 224. Each shear bar cradle 222 may be characterized by a radius of curvature equal to the circular section radius of a bow leg 234, 236.

The divergent leg shear bar 224 may be coupled to the recess insert 202 and lift anchor 12 by slidably seating each bow leg 234, 236 in an opposed shear bar cradle 222. The shear bar 224 may be fabricated with the bow legs 234, 236 somewhat inwardly inclined so that each bow leg 234, 236 may exert a compressive force against its correlative shear bar cradle 222 thereby. The relative inflexibility of the bow 232 may minimize flexure of the bow legs 234, 236, thereby urging the shear bar tabs 220 against the contact faces 106, 108 of the lift anchor head 24, and maintaining the recess insert 202 in a closed configuration around the lift anchor head 24.

After curing of the concrete in which the precast Portland cement concrete lift anchor assembly 200 is embedded, access to the lift anchor head 24 may be obtained by removing the obverse walls 212, 214 from the recess insert 202. This may be accomplished by utilizing a sharp tool to separate the obverse walls 212, 214 from the recess insert 202 along the quadrant flanges 208, 210. It may be recognized that embedment in concrete of the coupled shear bar 224 and shear bar tabs 220 may prevent separation of the quadrant-shaped portions 204, 206 from one another and from the lift anchor 12. Consequently, the lift anchor recess may be lined with the recess insert 202 rather than a concrete surface.

Coupling of the divergent leg shear bar 224 with the shear bar cradles 222 may also minimize movement of the shear bar 224 relative to the recess insert 202 and the lift anchor 12. The recess insert 202, lift anchor 12, and divergent leg shear bar 224 may collectively provide a high lifting capacity in both shear and tension, as a result of the use of forged feet with pre-stressing strand cutouts, welded connections, divergent leg shear bars, and the like, while minimizing the space occupied by the precast Portland cement concrete lift anchor assembly, enabling the concrete lift anchor assembly to be placed adjacent concrete surfaces without sacrificing lifting strength, and enabling greater flexibility in the design and construction of precast Portland cement concrete shapes.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A lift anchor assembly for a precast Portland cement concrete shape, the lift anchor assembly comprising:

a recess insert characterized by a longitudinal plane of symmetry, comprising a pair of quadrant-shaped bodies each characterized with a planar obverse wall, a contact plane, and a convex curved wall, the walls and plane collectively associated to define a quadrant-shaped shell, so that the longitudinal plane of symmetry bisects each of the planar obverse wall, contact plane, and convex curved wall;

a bilaterally symmetrical lift anchor head characterized by a longitudinal axis of symmetry, a lifting end, and an anchor leg end, the lifting end comprising an opening therethrough and a pair of embedment ears symmetrically disposed relative to the longitudinal axis of symmetry; and a pair of anchor legs, each anchor leg disposed along the anchor leg end, parallel to and equally spaced from the longitudinal axis of symmetry, characterized by a proximal end adjacent an embedment ear and a distal end terminating in a forged foot;

wherein each anchor leg is fixedly coupled with the anchor leg end by welding the proximal end to the anchor leg end;

wherein the contact planes are adapted for sandwiching the lift anchor head therebetween;

wherein the pair of quadrant-shaped bodies are joinable along the contact planes into the recess insert to define a 180° semicircular convex curved wall; and wherein the lift anchor head coupled with the anchor legs, and the recess insert coupled with the lift anchor head, extend the embedment ears and anchor legs beyond the periphery of the recess insert for embedment of the ears and anchor legs in Portland cement concrete.

2. A lift anchor assembly in accordance with claim 1, and further comprising a flange extending away from each quadrant-shaped body along the convex curved wall adjacent the planar obverse wall.

3. A lift anchor assembly in accordance with claim 2 wherein the flange is characterized by a triangular projection bisected by the longitudinal plane of symmetry, a width adjacent the contact plane, and a depth of the triangular projection along the longitudinal plane of symmetry being greater than the width.

4. A lift anchor assembly in accordance with claim 1 wherein the longitudinal axis of symmetry lies within the longitudinal plane of symmetry when the recess insert is coupled with the lift anchor head.

5. A lift anchor assembly in accordance with claim 1 wherein each quadrant-shaped body comprises a planar wall characterized by the contact plane.

6. A lift anchor assembly in accordance with claim 5 wherein the planar wall is characterized by a surface relief complementary with part of the lift anchor head.

7. A lift anchor assembly in accordance with claim 6 wherein the surface relief restricts movement of the lift anchor head relative to the recess insert.

8. A lift anchor assembly in accordance with claim 1, and further comprising at least one opening penetrable by a fastener in a first one of the pair of quadrant-shaped bodies.

9. A lift anchor assembly in accordance with claim 8 wherein the at least one opening is in the planar wall.

10. A lift anchor assembly in accordance with claim 8, and further comprising a fastener for penetrating the at least one opening.

11. A lift anchor assembly in accordance with claim 10 wherein the fastener is a friction fastener.

12. A lift anchor assembly in accordance with claim 1 wherein the quadrant-shaped bodies are identical.

13. A lift anchor assembly in accordance with claim 1 wherein the planar obverse walls terminate in a break line, and when the quadrant-shaped bodies are joined into the recess insert, an elongate triangular space is formed beneath the break line so that a force applied to the break line will urge the quadrant-shaped bodies into rotation out of the Portland cement concrete.

14. A lift anchor assembly in accordance with claim 1 wherein each forged foot has an arcuate recess that has sufficient diameter to accommodate a pre-stressing strand extending parallel to an anchor leg.

15. A lift anchor assembly for a precast Portland cement concrete shape, the lift anchor assembly comprising:

a recess insert characterized by a longitudinal plane of symmetry, and separable along a break line extending perpendicular to the longitudinal plane of symmetry into a pair of quadrant-shaped bodies, each characterized with a planar obverse wall;

a bilaterally symmetrical lift anchor characterized by a longitudinal axis of symmetry coextensive with the longitudinal plane of symmetry, immovably sandwiched between the quadrant-shaped bodies; and an elongate triangular space formed beneath the break line by an unseparated pair of quadrant-shaped bodies and extending orthogonal to the longitudinal plane of symmetry;

wherein the quadrant-shaped bodies are rotatable out of a Portland cement concrete shape by applying a force to the break line toward the elongate triangular space.

16. A lift anchor assembly for a precast Portland cement concrete shape, the lift anchor assembly comprising:

a recess insert that is adapted to form a recess in the precast Portland cement concrete shape;

a lift anchor characterized by a longitudinal axis, a lifting end, and an anchor leg end, the lifting end comprising an opening therethrough and a pair of embedment ears symmetrically disposed relative to the longitudinal axis of symmetry, and a portion of the lifting end is mounted within the recess insert; and a pair of anchor legs, each anchor leg attached to the anchor leg end of the lift anchor, aligned with the longitudinal axis, and a proximal end and a distal end, the distal end terminating in a foot that is wider than a diameter of the anchor legs, wherein each foot has an arcuate recess that that is configured to accommodate a pre-stressing strand extending parallel to an anchor leg.

17. The lift anchor assembly of claim 16 wherein the lift anchor is coupled with the anchor legs, and the recess insert is coupled to the lift anchor, and the embedment ears and anchor legs extend beyond the periphery of the recess insert for embedment of the ears and anchor legs in Portland cement concrete.

18. The lift anchor assembly of claim 16 wherein each foot of the anchor legs is forged.

* * * * *